US009175870B2

(12) United States Patent
Kakiuchi

(10) Patent No.: US 9,175,870 B2
(45) Date of Patent: Nov. 3, 2015

(54) AIR CONDITIONER WITH POSITIVE TEMPERATURE COEFFICIENT HEATERS

(75) Inventor: Atsushi Kakiuchi, Osaka (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 840 days.

(21) Appl. No.: 12/953,825

(22) Filed: Nov. 24, 2010

(65) Prior Publication Data

US 2011/0123180 A1 May 26, 2011

(30) Foreign Application Priority Data

Nov. 26, 2009 (JP) ..... 2009-268933

(51) Int. Cl.
*F24F 11/00* (2006.01)

(52) U.S. Cl.
CPC ..... *F24F 11/006* (2013.01); *F24F 2221/34* (2013.01); *F24F 2221/54* (2013.01)

(58) Field of Classification Search
CPC .... F25B 49/00; F25B 21/00; F25B 2321/021; H01L 23/34; H01L 23/345; H01L 23/36; F24H 9/1872; H05B 2203/02; H05B 1/02; H05B 2203/009; H05B 3/02; F24F 1/0007; F24F 11/0012; F24F 11/0076; F24F 11/04; F24F 11/053; F24F 13/20; F24F 2221/54; F24F 3/0442; F24F 3/0444; F24F 5/0042; F24F 7/007; F24F 2221/34; F24F 11/06; G05D 23/19; G05D 23/1902; G05D 23/1917; G05D 23/1927; G05D 23/24; G05D 23/2412; G05D 23/30; H05K 7/20; H05K 1/0201
USPC ..... 392/465, 466, 360, 361, 314–318, 323, 392/327, 334; 219/494, 492, 490, 552; 62/3.2, 3.3, 351, 228.4
See application file for complete search history.

(56) References Cited

U.S. PATENT DOCUMENTS 4,285,210 A * 8/1981 McCarty ..... 62/325
4,346,755 A * 8/1982 Alley et al. ..... 165/231

(Continued)

FOREIGN PATENT DOCUMENTS

JP 8-152179 A 6/1996
JP 2009-61138 A 3/2009

OTHER PUBLICATIONS

JP2 003059623 A Machine Translation.*

(Continued)

*Primary Examiner* — Eric Stapleton
(74) *Attorney, Agent, or Firm* — Birch, Stewart, Kolasch & Birch, LLP

(57) ABSTRACT

Provided is an air conditioner for performing heating operation through supply of a current to a heating portion including a plurality of positive temperature coefficient (PTC) heaters to be connected to a power supply section, the air conditioner including: a heater output control section for controlling an output of the heating portion; and a plurality of pulse signal generating sections provided correspondingly to the plurality of PTC heaters, each for generating a predetermined pulse signal when a corresponding one of the plurality of PTC heaters is supplied with the current, in which the plurality of PTC heaters are subjected to detection as to whether each of the PTC heaters is in a connected state or in a non-connected state based on presence/absence of the predetermined pulse signal, and the heater output control section subjects the heating portion to output control which is adjusted according to the number of the PTC heaters in the connected state.

14 Claims, 6 Drawing Sheets

(56) References Cited

U.S. PATENT DOCUMENTS

| | | | | | |
|---|---|---|---|---|---|
| 4,407,139 | A * | 10/1983 | Ide et al. | 62/215 |
| 4,439,995 | A * | 4/1984 | McCarty | 62/156 |
| 4,534,179 | A * | 8/1985 | Stocking et al. | 62/128 |
| 4,622,827 | A * | 11/1986 | Jabami et al. | 62/158 |
| 4,744,223 | A * | 5/1988 | Umezu | 62/176.5 |
| 5,074,120 | A * | 12/1991 | Kitamoto | 62/156 |
| 5,259,211 | A * | 11/1993 | Ikeda | 62/228.4 |
| 5,295,363 | A * | 3/1994 | Oomura et al. | 62/227 |
| 5,323,619 | A * | 6/1994 | Kim | 62/160 |
| 5,491,323 | A * | 2/1996 | Mori et al. | 219/710 |
| 5,592,647 | A * | 1/1997 | Yamauchi et al. | 392/432 |
| 5,673,568 | A * | 10/1997 | Isshiki | 62/228.4 |
| 6,134,901 | A * | 10/2000 | Harvest et al. | 62/228.4 |
| 6,192,700 | B1 * | 2/2001 | Runk et al. | 62/228.5 |
| 6,393,850 | B1 * | 5/2002 | Vanderstraeten | 62/196.3 |
| 6,513,341 | B2 * | 2/2003 | Nakajima | 62/228.4 |
| 6,817,198 | B2 * | 11/2004 | Wilson et al. | 62/228.3 |
| 7,036,329 | B2 * | 5/2006 | Ahmed et al. | 62/133 |
| 7,340,910 | B2 * | 3/2008 | Thompson | 62/186 |
| 7,458,227 | B2 * | 12/2008 | Lee et al. | 62/228.5 |
| 7,504,606 | B2 * | 3/2009 | Hamburger et al. | 219/543 |
| 7,513,123 | B2 * | 4/2009 | Lee et al. | 62/157 |
| 7,730,731 | B1 * | 6/2010 | Bash et al. | 62/198 |
| 7,739,882 | B2 * | 6/2010 | Evans et al. | 62/228.4 |
| 8,309,894 | B2 * | 11/2012 | Zimmer et al. | 219/552 |
| 2008/0124060 | A1 * | 5/2008 | Gao | 392/365 |
| 2011/0123180 | A1 * | 5/2011 | Kakiuchi | 392/465 |
| 2011/0123181 | A1 * | 5/2011 | Ariga | 392/466 |
| 2011/0198340 | A1 * | 8/2011 | Zimmer et al. | 219/494 |
| 2011/0303755 | A1 * | 12/2011 | Ariga | 237/2 A |

OTHER PUBLICATIONS

JP 08152179 A Machine Translation.*

* cited by examiner

AIR CONDITIONER WITH POSITIVE TEMPERATURE COEFFICIENT HEATERS

BACKGROUND OF THE INVENTION

1. Field of the Invention

The present invention relates to an air conditioner including a plurality of positive temperature coefficient (PTC) heaters.

2. Description of Related Art

A conventional air conditioner is disclosed in Japanese Patent Application Laid-open No. Hei 08-152179. The air conditioner has an integrated structure in which an indoor unit to be placed indoors is disposed in the front and an outdoor unit to be placed outdoors is disposed in the rear. In the outdoor unit, there are disposed a compressor for operating the refrigeration cycle and an outdoor heat exchanger connected to the compressor. The indoor unit has an inlet and an outlet opened therein. Inside the indoor unit, there are disposed an indoor heat exchanger connected to the compressor via a refrigerant pipe, and a heating portion including a plurality of PTC heaters.

When the temperature of the PTC heater exceeds the Curie point, the PTC heater increases in resistance, and hence a current value and a heating amount thereof are reduced. Accordingly, a stable amount of heating in a heating portion is obtained, which makes it easy to generate warm air of a predetermined temperature while preventing overheating. In this case, the resistance of the PTC heater changes depending on ambient temperature or an air flow rate. Therefore, predetermined control is carried out so as not to exceed power capacity, by monitoring a current value of the heating portion from the time of start-up of the PTC heater, when the resistance is low, until the PTC heater enters a stable state with high resistance.

When starting cooling operation, the refrigeration cycle is operated by the drive of the compressor, and the indoor heat exchanger serves as an evaporator on the low temperature side in the refrigeration cycle while the outdoor heat exchanger serves as a condenser on the high temperature side in the refrigeration cycle. The air in a room flows into the indoor unit from the inlet to be subjected to heat exchange with the indoor heat exchanger so that the air thus cooled is delivered to the room from the outlet. This way, cooling in the room is performed.

When starting heating operation, the refrigeration cycle is operated by the drive of the compressor, and the indoor heat exchanger serves as a condenser on the high temperature side in the refrigeration cycle while the outdoor heat exchanger serves as an evaporator on the low temperature side in the refrigeration cycle. The air in a room flows into the indoor unit from the inlet to be subjected to heat exchange with the indoor heat exchanger and is thereby heated. The air flowing into the indoor unit is further heated by the drive of the heating portion. The air thus heated is delivered to the room from the outlet, to thereby perform heating in the room.

The heating portion has different power capacity depending on where to install the air conditioner. At the installation, the number of the PTC heaters to be connected is adjusted according to a current value of the PTC heater in the stable state. In this case, depending on the number of the PTC heaters in a connected state, different control is carried out on the heating portion from the start-up until the stable state. Specifically, when the number of the PTC heaters in the connected state is large, the power capacity is high and hence the heating portion is controlled with an upper limit of the current value set high. On the other hand, when the number of the PTC heaters in the connected state is small, the power capacity is low and hence the heating portion is controlled with the upper limit of the current value set low. Therefore, it is necessary to detect the number of the PTC heaters in the connected state.

In a case where the number of the PTC heaters to be connected is set by an installation worker, an erroneous input is liable to happen. As a countermeasure, a plurality of current detecting circuits are provided correspondingly to the PTC heaters so as to detect the number of the PTC heaters in the connected state based on respective current values of the PTC heaters.

However, the current detecting circuit is expensive, leading to a problem of high cost of the air conditioner. Further, the current detecting circuit requires a large space for parts on a control board, which increases the size of the control board, leading to another problem of increased size of the air conditioner.

SUMMARY OF THE INVENTION

The present invention has an object of providing an air conditioner reduced in size and cost.

In order to achieve the above-mentioned object, according to the present invention, there is provided an air conditioner for performing heating operation through supply of a current to a heating portion including a plurality of positive temperature coefficient (PTC) heaters to be connected to a power supply section, the air conditioner including: a heater output control section for controlling an output of the heating portion; and a plurality of pulse signal generating sections provided correspondingly to the plurality of PTC heaters, each for generating a predetermined pulse signal when a corresponding one of the plurality of PTC heaters is supplied with the current, in which the plurality of PTC heaters are subjected to detection as to whether each of the plurality of PTC heaters is in a connected state or in a non-connected state based on presence/absence of the predetermined pulse signal, and the heater output control section subjects the heating portion to output control which is adjusted according to a number of the PTC heaters in the connected state.

According to this configuration, the heating portion includes the plurality of PTC heaters, and the number of the PTC heaters to be connected is adjusted according to power capacity in a place where the air conditioner is installed. The pulse signal generating section provided to each of the PTC heaters outputs the predetermined pulse signal when the corresponding PTC heater is in the connected state. Depending on the number of the PTC heaters for which the pulse signals are output, the heater output control section adjusts the output control on the heating portion, to thereby heat the heating portion. Then, the air thus heated by the heating portion is discharged to a room, to thereby perform the heating operation.

Further, according to the present invention, in the air conditioner having the above-mentioned configuration, it is preferred that the plurality of pulse signal generating sections each generate the predetermined pulse signal according to a cycle of the power supply section when the corresponding one of the plurality of PTC heaters is in the connected state. According to this configuration, when current is supplied to the PTC heater from the AC power supply section, the pulse signal is generated according to the cycle of the power supply section, to thereby allow the connection state of the PTC heater to be detected based on the presence/absence of the pulse signal.

Further, according to the present invention, it is preferred that the air conditioner having the above-mentioned configuration further include a zero-cross detecting section for detecting zero-crossing of the power supply section, and that the plurality of pulse signal generating sections produce outputs which are acquired respectively every time the zero-cross detecting section detects the zero-crossing of the power supply section. According to this configuration, every time the zero-cross detecting section detects the zero-crossing in a half cycle of the power supply section, the output of the pulse signal generating section is acquired. By acquiring the output of the pulse signal generating section successively a plurality of times, it is possible to detect the pulse signal which is generated in every one cycle of the power supply section when the PTC heater is in the connected state.

Further, according to the present invention, in the air conditioner having the above-mentioned configuration, it is preferred that the plurality of pulse signal generating sections produce outputs which are acquired respectively, by counting of a timer, in a cycle other than an integer multiple of the cycle of the power supply section. According to this configuration, by counting of the timer, the output of the pulse signal generating section is acquired in, for example, every half cycle of the power supply section. Accordingly, it is possible to detect the pulse signal which is generated in every one cycle of the power supply section when the PTC heater is in the connected state.

Further, according to the present invention, in the air conditioner having the above-mentioned configuration, it is preferred that the heating portion be controlled by the heater output control section based on detection results obtained by detecting a plurality of times whether or not the plurality of PTC heaters are in the connected state. According to this configuration, an erroneous detection on the connection state of the PTC heater is prevented.

Further, according to the present invention, it is preferred that the air conditioner having the above-mentioned configuration further include a current detecting section for detecting a current value of the heating portion, and that the heater output control section adjust an upper limit of the current value of the heating portion according to the number of the PTC heaters in the connected state. According to this configuration, a single current detecting section monitors a total current of the heating portion including the plurality of PTC heaters, and the heating portion is controlled by the heater output control section so as not to exceed the upper limit of the current value, which is adjusted according to the number of the PTC heaters.

According to the present invention, the plurality of pulse signal generating sections provided correspondingly to the plurality of PTC heaters each generate the predetermined pulse signal when the corresponding PTC heater is supplied with a current. Then, based on the presence/absence of the pulse signal, whether the corresponding PTC heater is in the connected state or in the non-connected state is detected, and the output control on the heating portion by the heater output control section is adjusted according to the number of the PTC heaters in the connected state. Accordingly, without providing a current detecting circuit correspondingly to each of the PTC heaters, the number of the PTC heaters in the connected state may be detected with ease. Therefore, the air conditioner may be reduced in cost and size.

DETAILED DESCRIPTION OF PREFERRED EMBODIMENT

Figure 1:
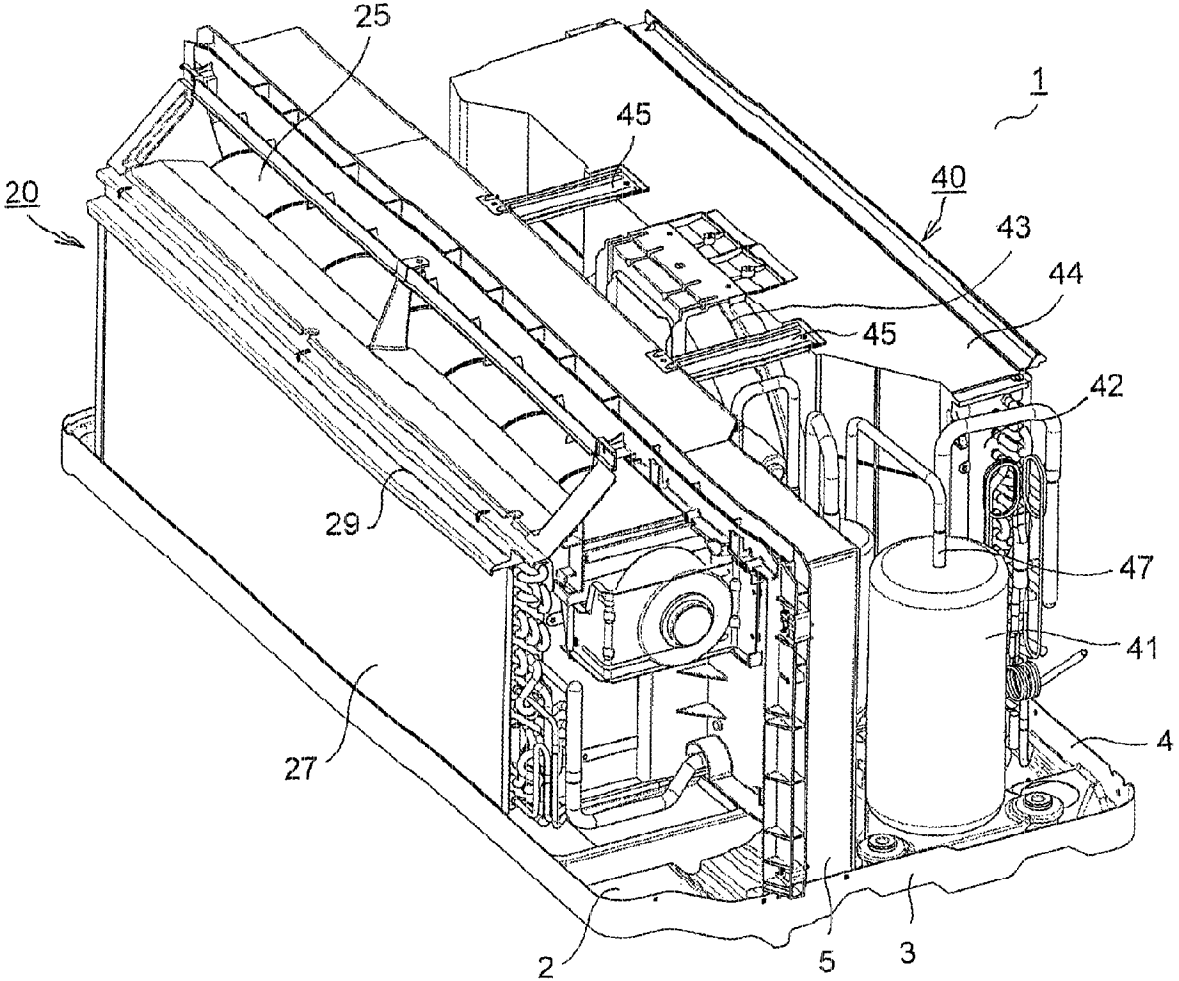
FIG. 1 is a perspective view illustrating an air conditioner according to an embodiment of the present invention.
Figure 2:
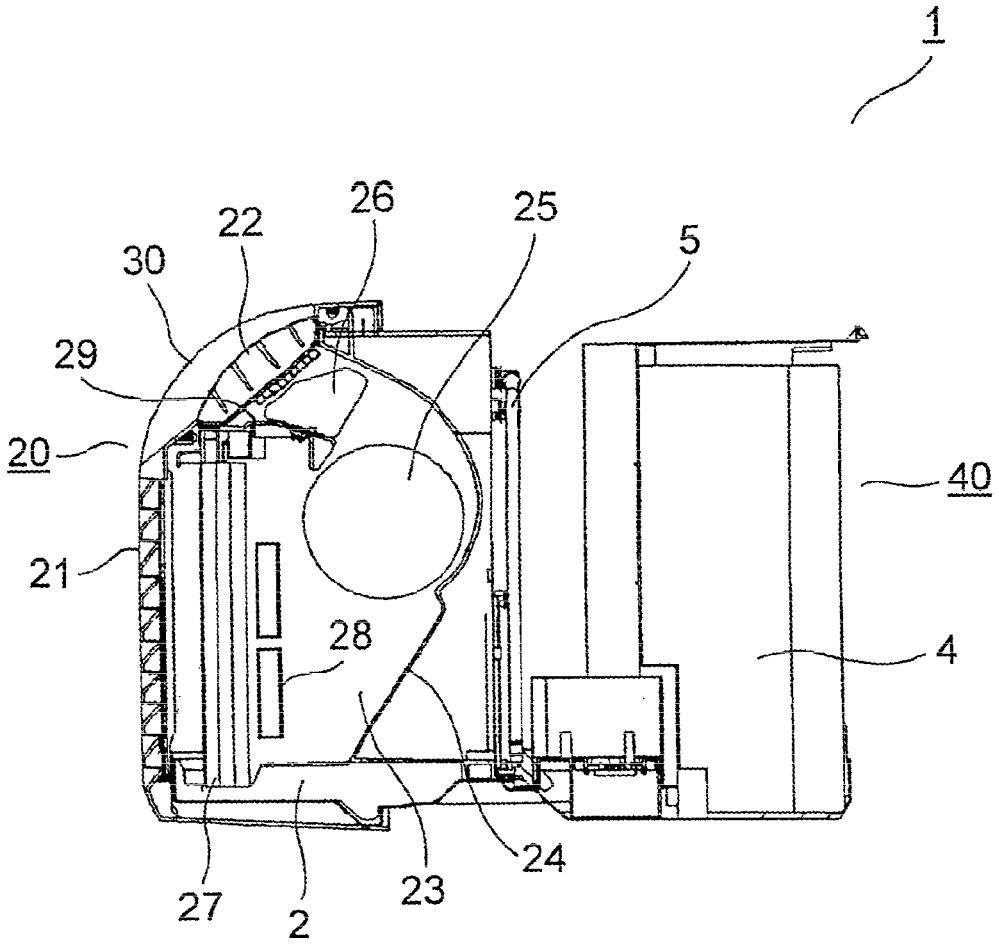
FIG. 2 is a side sectional view illustrating the air conditioner according to the embodiment of the present invention.

Hereinafter, an embodiment of the present invention is described with reference to the accompanying drawings. FIG. 1 and FIG. 2 are a perspective view and a side sectional view, respectively, illustrating an air conditioner 1 according to the embodiment. FIG. 1 illustrates a state where an outer cover 30 (see FIG. 2) is detached. The air conditioner 1 has an integrated structure including an indoor unit 2 which is to be placed indoors and an outdoor unit 4 which is to be placed outdoors contiguous to the indoor unit 2.

The indoor unit 2 is provided with an inlet 21 in the front, and the outdoor unit 4 is provided with an outdoor heat exchanger 42 in the front. In the following description, the inlet 21 side is referred to as front side, and the outdoor heat exchanger 42 side is referred to as rear (back) side. Further, the right and left sides of the inlet 21 when facing forward are referred to as right and left sides of the air conditioner 1.

The indoor unit 2 and the outdoor unit 4 are installed on a bottom plate 3 and separated longitudinally by a partition wall 5. The indoor unit 2 forms a casing 20 delimited by the bottom plate 3, the partition wall 5, and the outer cover 30. Similarly, the outdoor unit 4 forms a casing 40 delimited by the bottom plate 3, the partition wall 5, and an outer cover (not shown).

In the outdoor unit 4, a compressor 41 for operating the refrigeration cycle is disposed at a right side end portion. On the back side of the outdoor unit 4, the outdoor heat exchanger 42 is disposed and connected to the compressor 41 via a refrigerant pipe 47. An outdoor fan 43 in the form of a propeller fan is disposed at a horizontal central portion so as to face the outdoor heat exchanger 42. The outdoor fan 43 and the outdoor heat exchanger 42 are disposed in a housing 44. The housing 44 forms a duct for guiding air flow from the outdoor fan 43 to the outdoor heat exchanger 42. The housing 44 is supported by the partition wall 5 via brackets 45.

The inlet 21 is opened in a front surface of the outer cover 30 covering the indoor unit 2, and an outlet 22 is opened therein above the inlet 21. Inside the indoor unit 2, the inlet 21 and the outlet 22 are coupled by a blower duct 24 to form a blower passage 23. The blower duct 24 includes a duct member 29 as its upper part, which is detachable when the outer cover 30 is detached. The duct member 29 constitutes the lower wall of the blower passage 23 in the vicinity of the outlet 22.

Inside the blower passage 23, a blower fan 25 in the form of a cross-flow fan is provided. In the vicinity of the outlet 22 inside the blower passage 23, a louver 26 for adjusting the direction of air flow is provided. Between the blower fan 25 and the inlet 21, an indoor heat exchanger 27 is disposed and connected to the compressor 41 via the refrigerant pipe 47.

Between the blower fan 25 and the indoor heat exchanger 27, a heating portion 28 is disposed. The indoor heat exchanger 27 and the heating portion 28 are covered by the duct member 29 from above. When the duct member 29 is detached, the heating portion 28 is detachable.

Figure 3:
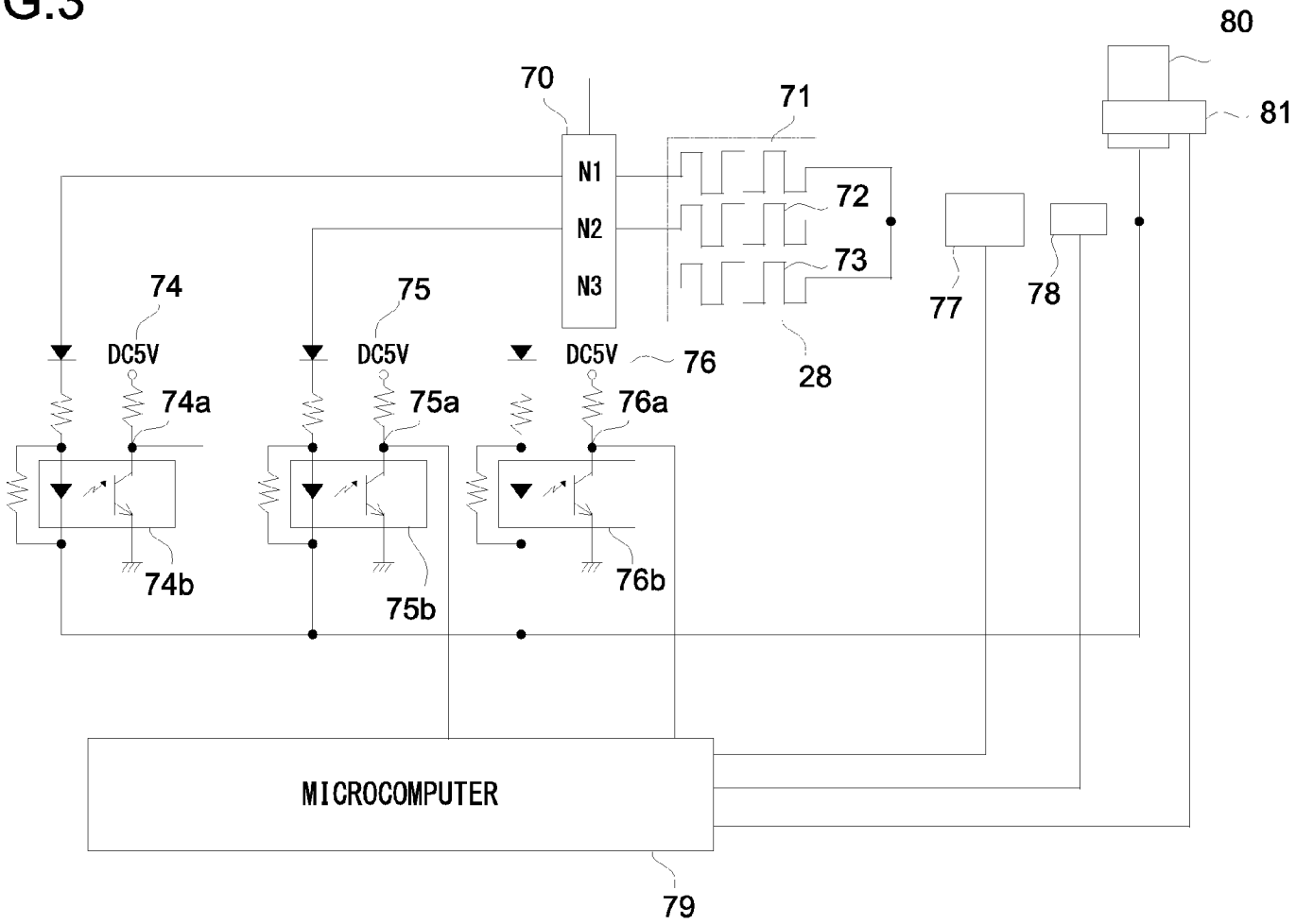
FIG. 3 is a circuit diagram illustrating a drive circuit of a heating portion in the air conditioner according to the embodiment of the present invention.

FIG. 3 is a circuit diagram illustrating a drive circuit of the heating portion 28. In the heating portion 28, a plurality of PTC heaters 71, 72, and 73 are stacked and adhered to a honeycomb fin portion (not shown) for carrying out heat exchange with air flowing through the blower passage 23 (see FIG. 2). The air conditioner 1 is supplied with AC power from a power supply section 80 connected to a commercial power source. To the power supply section 80, at least one terminal of the PTC heaters 71, 72, and 73 is connected in parallel via a terminal section 70.

Figure 4A:
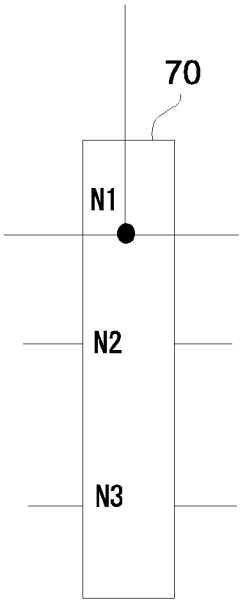
FIGS. 4A to 4E each illustrate a connection state of a positive temperature coefficient (PTC) heater in the air conditioner according to the embodiment of the present invention.
Figure 4B:
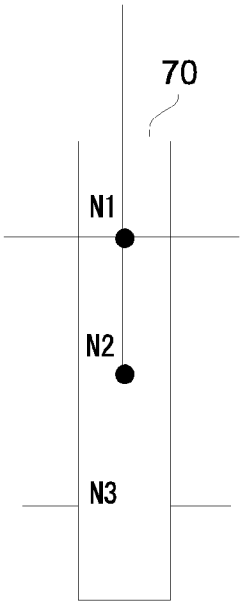
Figure 4C:
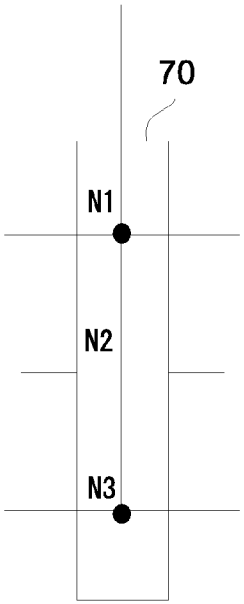
Figure 4D:
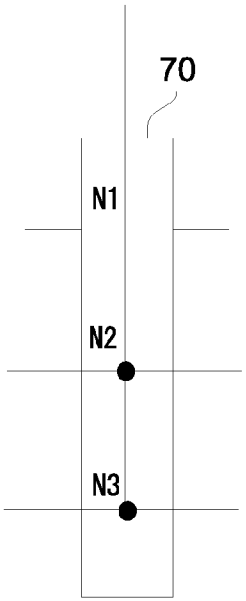
Figure 4E:
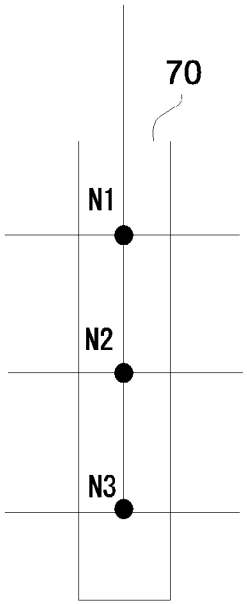

The terminal section 70 includes terminals N1, N2, and N3 to be connected to the PTC heaters 71, 72, and 73, respectively. Then, as illustrated in FIGS. 4A to 4E, the number of connections of the PTC heaters 71, 72, and 73 is adjusted at the installation according to power capacity in a place where the air conditioner 1 is installed. Specifically, in FIG. 4A, the PTC heater 71 is in a connected state while the PTC heaters 72 and 73 are in a non-connected state. In FIG. 4B, the PTC heaters 71 and 72 are in the connected state while the PTC heater 73 is in the non-connected state. In FIG. 4C, the PTC heaters 71 and 73 are in the connected state while the PTC heater 72 is in the non-connected state. In FIG. 4D, the PTC heaters 72 and 73 are in the connected state while the PTC heater 71 is in the non-connected state. In FIG. 4E, the PTC heaters 71, 72, and 73 are in the connected state.

Another terminal of each of the PTC heaters 71, 72, and 73 is connected to a heater output control section 77. The heater output control section 77 includes a triac circuit or a relay circuit, and controls the respective outputs of the PTC heaters 71, 72, and 73. In the case of performing duty control on the PTC heaters 71, 72, and 73, the heater output control section 77 is desired to be formed of a triac circuit. The triac circuit may reduce switching sound accompanying switching, compared with the relay circuit.

Between the heater output control section 77 and the power supply section 80, a current detecting section 78 for detecting a current flowing through the heating portion 28 is provided. The power supply section 80 is provided with a zero-cross detecting section 81 for detecting zero-crossing of the AC power.

The terminal section 70 is connected to pulse signal generating sections 74, 75, and 76 which are branched from the respective terminals N1, N2, and N3 of the terminal section 70, respectively. The pulse signal generating sections 74, 75, and 76 are respectively provided with output terminals 74*a*, 75*a*, and 76*a* connected to a microcomputer 79. The output terminals 74*a*, 75*a*, and 76*a* are applied with DC 5 V and grounded via rectifier circuits 74*b*, 75*b*, and 76*b* which are connected to the PTC heaters 71, 72, and 73, respectively.

Accordingly, under a state in which the PTC heaters 71, 72, and 73 are in the non-connected state or applied with a negative voltage, the pulse signal generating sections 74, 75, and 76 respectively output 5 V (High) from the output terminals 74*a*, 75*a*, and 76*a*. On the other hand, under a state in which the PTC heaters 71, 72, and 73 are applied with a positive voltage, the pulse signal generating sections 74, 75, and 76 respectively output a voltage (Low) lower than 5 V from the output terminals 74*a*, 75*a*, and 76*a*. Therefore, the pulse signal generating sections 74, 75, and 76 respectively generate a pulse signal P1 (see FIG. 6) which alternates between High and Low according to a cycle of the power supply section 80 when the PTC heaters 71, 72, and 73 are in the conducted state.

Further, the heater output control section 77, the current detecting section 78, and the zero-cross detecting section 81 are connected to the microcomputer 79. The microcomputer 79 detects the presence/absence of the pulse signals P1, based on the outputs of the pulse signal generating sections 74, 75, and 76 and the output of the zero-cross detecting section 81, and thereby performs connection determination as to whether the PTC heaters 71, 72, and 73 are in the connected state or in the non-connected state. Then, results of the connection determination on the PTC heaters 71, 72, and 73 are sent to the heater output control section 77. The heater output control section 77 controls the heating portion 28 so that the current value of the heating portion 28, which is monitored by the current detecting section 78, is prevented from exceeding an upper limit of the current value set according to the connection state of the PTC heaters 71, 72, and 73.

Figure 5:
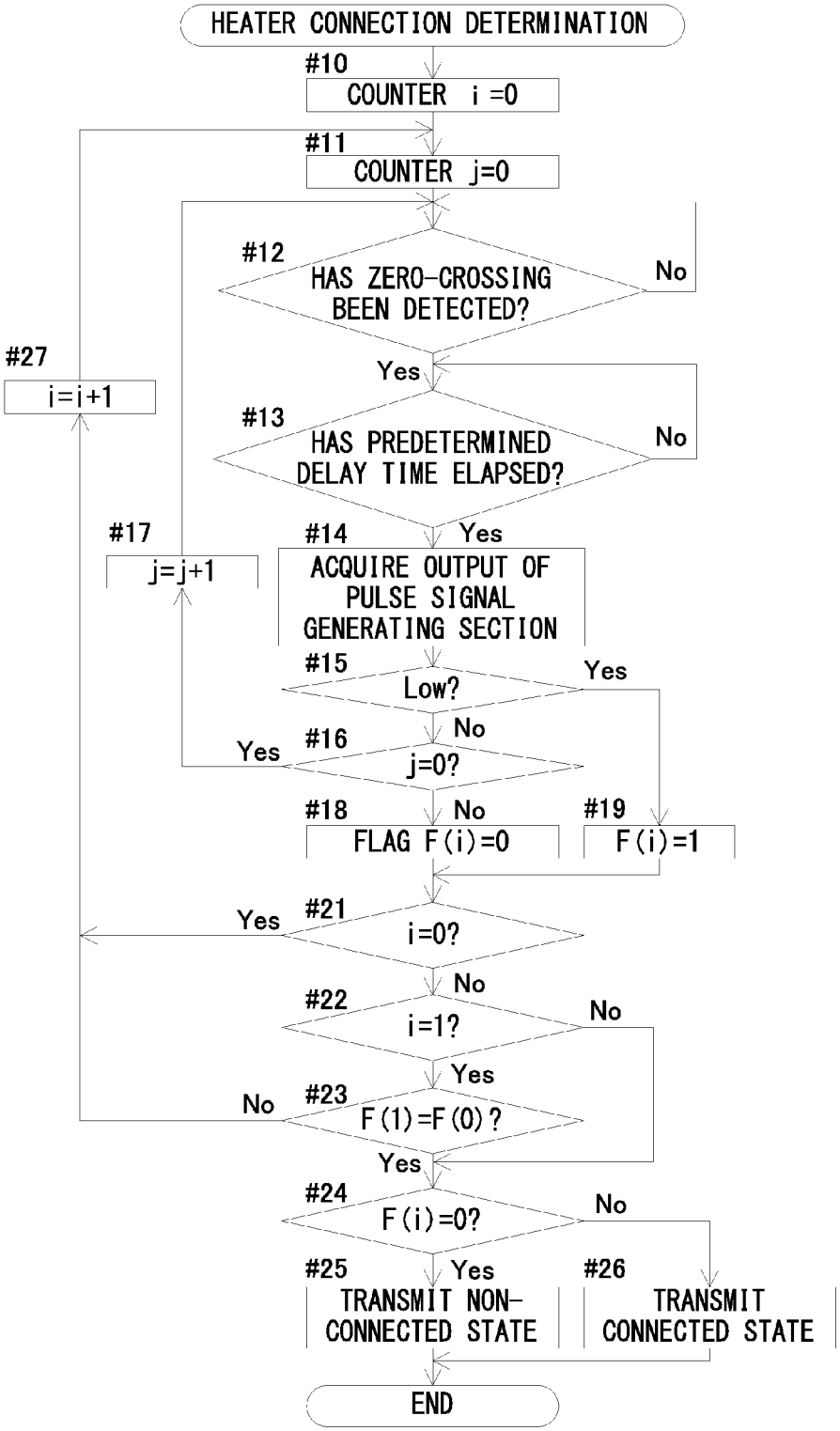
FIG. 5 is a flow chart illustrating an operation of connection determination on the PTC heater in the air conditioner according to the embodiment of the present invention.
Figure 6:
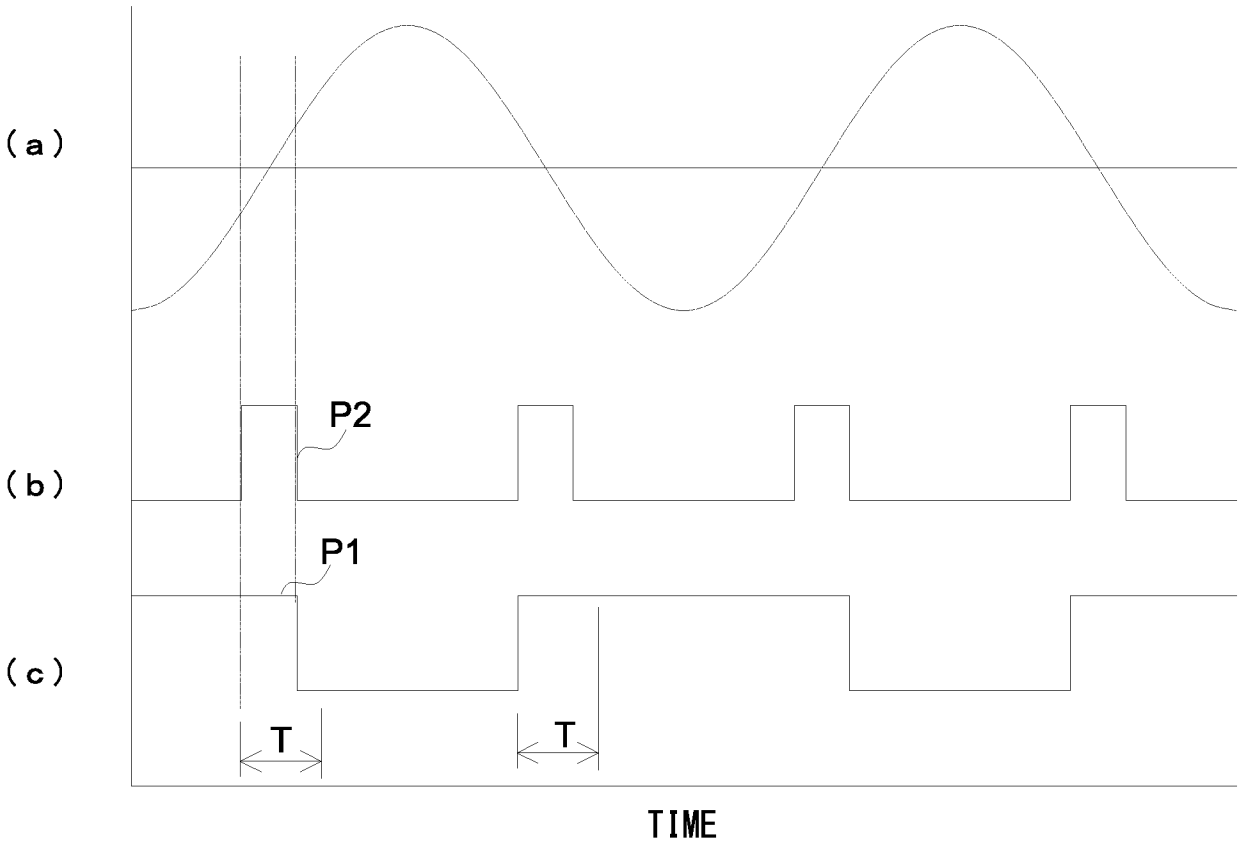
FIG. 6 is a time chart illustrating the operation of the connection determination on the PTC heater in the air conditioner according to the embodiment of the present invention.

FIG. 5 and FIG. 6 are a flow chart and a time chart, respectively, illustrating an operation of the connection determination on the PTC heater 71 by the microcomputer 79. The connection determination on the PTC heaters 72 and 73 is performed in parallel by the same operation. The part (a) of FIG. 6 shows a voltage of the power supply section 80, the part (b) of FIG. 6 shows an output of the zero-cross detecting section 81, and the part (c) of FIG. 6 shows each output of the pulse signal generating sections 74, 75, and 76.

The zero-cross detecting section 81 detects zero-crossing of the power supply section 80 to generate a pulse signal P2 in every half cycle. When the PTC heaters 71, 72, and 73 are in the connected state, the pulse signal generating sections 74, 75, and 76 respectively output in every one cycle the pulse signal P1 of High with the negative voltage of the power supply section 80 and output the pulse signal P1 of Low with the positive voltage thereof.

In Step #10 of FIG. 5, a counter i is initialized. The counter i represents the number of times of detecting whether or not the PTC heater 71 is in the connected state. In Step #11, a counter j is initialized. The counter j represents the number of times of detecting zero-crossing of the power supply section 80. In Step #12, the processing stands by until the pulse signal P2 of the zero-cross detecting section 81 is detected. When the pulse signal P2 of the zero-cross detecting section 81 is detected, the processing proceeds to Step #13 and stands by until a predetermined delay time T (see part (c) of FIG. 6) elapses.

After a lapse of the delay time T, the processing proceeds to Step #14, where the output of the pulse signal generating section 74 is acquired. When the pulse signal P1 is generated, for example, an output alternating between Low and High is acquired from the pulse signal generating section 74 in every half cycle of the power supply section 80. On the other hand, when the pulse signal P1 is not generated, a continuous output of High is acquired from the pulse signal generating section 74 in every half cycle of the power supply section 80. Therefore, the generation of the pulse signal P1 may be detected by the detection of Low.

In Step #15, it is determined whether or not the output of the pulse signal generating section 74 is Low. When the output of the pulse signal generating section 74 is Low, the processing proceeds to Step #19, where 1 is substituted for a flag F(0) indicating the detection of the pulse signal P1. The flag F(i) is an array variable corresponding to the counter i. When the output of the pulse signal generating section 74 is High, it is determined in Step #16 whether the counter j is 0 or not. When the counter j is 0, the counter j is incremented in Step #17, and Steps #12 to #15 are performed again.

Then, it is determined in Step #15 whether or not the output of the pulse signal generating section 74 is Low. When the output of the pulse signal generating section 74 is Low, the processing proceeds to Step #19, where 1 is substituted for the flag F(0). When the output of the pulse signal generating section 74 is High, the processing proceeds to Step #18, where 0 is substituted for the flag F(0). This way, in the case where the output of the pulse signal generating section 74 exhibits High two successive times, the flag F(0) stores 0, whereas in the case where the output thereof exhibits Low at least once out of twice, the flag F(0) stores 1.

In Step #21, it is determined whether the counter i is 0 or not. When the counter i is 0, the counter i is incremented in Step #27, and Steps #11 to #19 are performed again. This way, 1 or 0 is substituted for the flag F(1).

In Step #22, it is determined whether the counter i is 1 or not. When the counter i is 1, it is determined in Step #23 whether or not the flag F(1) and the flag F(0) match. When the flag F(1) and the flag F(0) match, this means agreement between the results of detection performed twice as to whether or not the PTC heater 71 is in the connected state. Then, the processing proceeds to Step #24.

In Step #24, it is determined whether the flag F(i) (that is, F(1)) is 0 or not. When the flag F(1) is 0, in Step #25, the detection result that the PTC heater 71 is in the non-connected state is transmitted to the heater output control section 77. When the flag F(1) is 1, in Step #26, the detection result that the PTC heater 71 is in the connected state is transmitted to the heater output control section 77.

When the flag F(1) and the flag F(0) do not match in Step #23, the counter i is incremented in Step #27, and Steps #11 to #19 are performed again. This way, 1 or 0 is substituted for the flag F(2). Then, through determination in Steps #21 and #22, the processing proceeds to Step #24 because the counter i is 2.

In Step #24, it is determined whether the flag F(i) (that is, F(2)) is 0 or not. When the flag F(2) is 0, in Step #25, the detection result that the PTC heater 71 is in the non-connected state is transmitted to the heater output control section 77. When the flag F(2) is 1, in Step #26, the detection result that the PTC heater 71 is in the connected state is transmitted to the heater output control section 77.

In the air conditioner 1 having the above-mentioned configuration, when starting cooling operation, the refrigeration cycle is operated by the drive of the compressor 41. Then, the indoor heat exchanger 27 serves as an evaporator on the low temperature side in the refrigeration cycle while the outdoor heat exchanger 42 serves as a condenser on the high temperature side in the refrigeration cycle. The outdoor heat exchanger 42 is cooled by the outdoor fan 43 to dissipate heat. By the drive of the blower fan 25, the air in a room flows into the blower passage 23 from the inlet 21 to be subjected to heat exchange with the indoor heat exchanger 27 so that the air thus cooled is delivered to the room from the outlet 22. This way, cooling in the room is performed.

When starting heating operation, the refrigeration cycle is operated by the drive of the compressor 41. Then, the indoor heat exchanger 27 serves as a condenser on the high temperature side in the refrigeration cycle while the outdoor heat exchanger 42 serves as an evaporator on the low temperature side in the refrigeration cycle. The outdoor heat exchanger 42 is heated by the outdoor fan 43. By the drive of the blower fan 25, the air in a room flows into the blower passage 23 from the inlet 21 to be subjected to heat exchange with the indoor heat exchanger 27 and is thereby heated.

The air in the blower passage 23 is further heated by the drive of the heating portion 28. When the heating portion 28 is driven, the current detecting section 78 monitors a current value of the heating portion 28. Then, the heater output control section 77 increases the output of the heating portion 28 gradually from the time of start-up of the PTC heaters 71, 72, and 73, when the resistance is low, until the PTC heaters 71, 72, and 73 enter a stable state with high resistance. Increasing the output of the heating portion 28 is performed by, for example, increasing a duty ratio gradually. This way, control is made so that the current value of the heating portion 28, which is detected by the current detecting section 78, is prevented from exceeding an upper limit of the current value set based on power capacity.

In this case, the upper limit of the current value of the heating portion 28 is adjusted according to the number of the PTC heaters 71, 72, and 73 in the connected state. Specifically, in the case where the number of the PTC heaters 71, 72, and 73 in the connected state is small, the power capacity is determined to be low and accordingly the upper limit of the current value is set low. In the case where the number of the PTC heaters 71, 72, and 73 in the connected state is large, the power capacity is determined to be high and accordingly the upper limit of the current value is set high.

Further, the air flowing through the blower passage 23 is subjected to heat exchange with the fin portion (not shown) of the heating portion 28, and hence the PTC heaters 71, 72, and 73 are prevented from being overheated.

The air thus heated by the indoor heat exchanger 27 and the heating portion 28 is delivered to a room from the outlet 22, to thereby perform heating operation. During the heating operation, only the heating portion 28 may be used to heat air while stopping the compressor 41.

According to the embodiment of the present invention, the plurality of pulse signal generating sections 74, 75, and 76 provided correspondingly to the plurality of PTC heaters 71, 72, and 73 generate the predetermined pulse signals P1 when the respective PTC heaters 71, 72, and 73 are supplied with current. Then, based on the presence/absence of the pulse signals P1, the connected state or the non-connected state of the respective PTC heaters 71, 72, and 73 is detected, and the output control on the heating portion 28 by the heater output control section 77 is thereby adjusted according to the number of the PTC heaters 71, 72, and 73 in the connected state. This way, without providing a current detecting circuit correspondingly to each of the PTC heaters 71, 72, and 73, the number of the PTC heaters 71, 72, and 73 in the connected state may be detected with ease. Therefore, the air conditioner 1 may be reduced in cost and size.

Further, the pulse signal generating sections 74, 75, and 76 respectively generate the pulse signals P1 according to the cycle of the power supply section 80 when the PTC heaters 71, 72, and 73 are in the connected state. Therefore, the pulse signals P1 may be generated simply.

Besides, the outputs of the pulse signal generating sections 74, 75, and 76 are acquired every time the zero-cross detecting section 81 detects zero-crossing of the power supply section 80. Therefore, the presence/absence of the pulse signals P1 may be detected with ease.

Note that, omitting the zero-cross detecting section 81, the outputs of the pulse signal generating sections 74, 75, and 76 may be acquired, by counting of a timer instead, in a cycle other than an integer multiple of the cycle of the power supply section 80. For example, in a case where the outputs of the pulse signal generating sections 74, 75, and 76 are acquired ten times in every half cycle of the power supply section 80, Low of the pulse signals P1 is generated five times out of the ten times. Then, when Low is detected three times or more, it is determined that the corresponding PTC heater is connected, whereas, when Low is detected less than three times, it is determined that the corresponding PTC heater is not connected. This way, even if an erroneous detection of Low may occur, the connection state of the PTC heater may be detected with accuracy.

Further, the heating portion 28 is controlled by the heater output control section 77 based on detection results obtained by detecting twice or three times whether or not the PTC heaters 71, 72, and 73 are in the connected state. Therefore, an erroneous detection as to whether or not the PTC heaters 71, 72, and 73 are in the connected state may be prevented. Note that, the heating portion 28 may be controlled based on results obtained by detecting for larger number of times whether or not the PTC heaters 71, 72, and 73 are in the connected state.

Still further, the current detecting section 78 for detecting the current value of the heating portion 28 is provided so that the heater output control section 77 controls the heating portion 28 by adjusting the upper limit current value of the heating portion 28 according to the number of the PTC heaters 71, 72, and 73 in the connected state. This way, the heating portion 28 may be controlled so as not to exceed the power capacity in a place where the air conditioner 1 is installed, and in the case of high power capacity, the heating portion 28 may be heated quickly.

The present invention is applicable to an air conditioner including a plurality of PTC heaters.

What is claimed is:

1. An air conditioner comprising:

an indoor unit having an inlet and an outlet;

an indoor heat exchanger arranged in the indoor unit;

a blower duct connecting between the inlet and the outlet inside the indoor unit and forming a blower passage;

a blower fan arranged in the blower passage;

an outdoor unit having a housing;

an outdoor heat exchanger arranged in the housing;

an outdoor fan arranged in the housing;

a compressor connected to the indoor and outdoor heat exchangers via refrigerant pipe;

a power supply section;

a terminal section;

a heating portion having a plurality of positive temperature coefficient (PTC) heaters;

a heater output control section for controlling an output of the heating portion;

a plurality of signal generating sections, provided one for each of the plurality of PTC heaters; and a microcomputer connected to the heater output control section and the plurality of signal generating sections, wherein the power supply section is connected to all or part of the PTC heaters via the terminal section, when the power supply section is connected to part of the PTC heaters via the terminal section, the power supply section is not connected to the rest of the PTC heaters via the terminal section, each of the signal generating sections has an output terminal that is connected to the microcomputer, that is applied with a predetermined voltage, and that is grounded via a rectifier circuit, each of the signal generating sections is, when a corresponding one of the PTC heaters is connected to the power supply section via the terminal section, connected to the power supply section via the terminal section and outputs a pulse signal in a form of square wave comprising only two values of High and Low, and when a corresponding one of the PTC heaters is not connected to the power supply section via the terminal section, not connected to the power supply section via the terminal section and outputs a High signal comprising a single value of High, the microcomputer receives the pulse signal or the High signal output from each of the signal generating sections, detects that each of the PTC heaters is connected to the power supply section via the terminal section based on the pulse signal, and detects that each of the PTC heaters is not connected to the power supply section via the terminal section based on the High signal, the heater output control section subjects the heating portion to output control which is adjusted according to a number of the PTC heaters connected to the power supply section via the terminal section as detected by the microcomputer during heating operation, and during the heating operation, the compressor, the blower fan, and the outdoor fan are driven, the indoor heat exchanger acts as a condenser on a high temperature side in a refrigeration cycle, and the outdoor heat exchanger acts as an evaporator on a low temperature side in the refrigeration cycle.

2. An air conditioner according to claim 1, wherein the power supply section supplies AC power, the pulse signal alternates between High and Low periodically, and a period of one cycle of the pulse signal equals a period of one cycle of the AC power.

3. An air conditioner according to claim 2, further comprising a zero-cross detecting section for detecting zero-crossing of the power supply section, wherein the zero-cross detecting section is connected to the microcomputer, and the microcomputer acquires outputs of the respective signal generating sections every time the zero-cross detecting section detects the zero-crossing of the power supply section.

4. An air conditioner according to claim 2, wherein the microcomputer acquires, by counting of a timer, outputs of the respective signal generating sections at a period other than an integer multiple of the one cycle of the power supply section.

5. An air conditioner according to claim 1, wherein the microcomputer acquires outputs of the respective pulse signal generating sections a plurality of times.

6. An air conditioner according to claim 1, further comprising a current detecting section for detecting a current value of the heating portion, wherein the current detecting section is connected to the heater output control section, and the heater output control section controls the heating portion such that the current value detected by the current detecting section does not exceed an upper limit, and adjusts the upper limit according to the number of the PTC heaters connected to the power supply section via the terminal section.

7. The air conditioner according to claim 1, wherein the terminal section includes a plurality of terminals.

8. An air conditioner comprising:

an indoor unit having an inlet and an outlet;

an indoor heat exchanger arranged in the indoor unit;

a blower duct connecting between the inlet and the outlet inside the indoor unit and forming a blower passage;

a blower fan arranged in the blower passage an outdoor unit having a housing;

an outdoor heat exchanger arranged in the housing;

an outdoor fan arranged in the housing;

a compressor connected to the indoor and outdoor heat exchangers via refrigerant pipe;

a power supply section;

a terminal section;

a heating portion having a plurality of positive temperature coefficient (PTC) heaters;

a heater output control section for controlling an output of the heating portion;

a plurality of signal generating sections provided one for each of the plurality of PTC heaters; and a microcomputer connected to the heater output control section and the plurality of signal generating sections wherein the power supply section is connected to all or part of the PTC heaters via the terminal section, when the power supply section is connected o part of the PTC heaters via the terminal section, the power supply section is not connected to the rest of the PTC heaters via the terminal section, each of the signal generating sections is, when a corresponding one of the PTC heaters is connected to the power supply section via the terminal section, connected to the power supply section via the terminal section, and when a corresponding one of the PTC heaters is not connected to the power supply section via the terminal section, not connected to the power supply section via the terminal section, each of the signal generating sections includes:

a voltage application terminal to which a predetermined direct-current voltage is applied;

an output terminal connected to the microcomputer;

a ground terminal grounded;

a pull-up resistor provided between the voltage application terminal and the output terminal;

a switch provided between the output terminal and the ground terminal; and a switch control section which, when a corresponding one of the PTC heaters is connected to the power supply section via the terminal section, turns on and off the switch according to AC power supplied form the power supply section, and when a corresponding one of the PTC heaters is not connected to the power supply section via the terminal section, keeps the switch off, the microcomputer receives an output from each of the signal generating sections, and detects whether or not each of the PTC heaters is connected to the power supply section via the terminal section based on the output from each of the signal generating sections, the heater output control section subjects the heating portion to output control which is adjusted to a number of the PTC heaters connected to the power supply section via the terminal section as detected by the microcomputer during heating operation, and during the heating operation, the compressor, the blower fan, and the outdoor fan are driven, the indoor heat exchanger acts as a condenser on a high temperature side in a refrigeration cycle, and the outdoor heat exchanger acts as an evaporator on a low temperature side in the refrigeration cycle.

9. An air conditioner according to claim 8, wherein the pulse signal alternates between High and Low periodically, and a period of one cycle of the pulse signal equals a period of one cycle of the AC power.

10. An air conditioner according to claim 9, further comprising a zero-cross detecting section for detecting zero-crossing of the power supply section, wherein the zero-cross detecting section is connected to the microcomputer, and the microcomputer acquires outputs of the respective signal generating sections every time the zero-cross detecting section detects the zero-crossing of the power supply section.

11. An air conditioner according to claim 9, wherein the microcomputer acquires, by counting of a timer, outputs of the respective signal generating sections at a period other than an integer multiple of the one cycle of the power supply section.

12. An air conditioner according to claim 8, wherein the microcomputer acquires outputs of the respective signal generating sections a plurality of times.

13. An air conditioner according to claim 8, further comprising a current detecting section for detecting a current value of the heating portion, wherein the current detecting section is connected to the heater output control section, and the heater output control section controls the heating portion such that the current value detected by the current detecting section does not exceed an upper limit and adjusts the upper limit according to the number of the PTC heaters connected to the power supply section via the terminal section.

14. The air conditioner according to claim 8, wherein the terminal section includes a plurality of terminals.

* * * * *